US006484692B2

(12) United States Patent
Umemoto et al.

(10) Patent No.: US 6,484,692 B2
(45) Date of Patent: Nov. 26, 2002

(54) IGNITION CONTROL SYSTEM

(75) Inventors: Hideki Umemoto, Tokyo (JP); Tadayuki Saga, Hyogo (JP); Tatsuji Irie, Tokyo (JP); Wataru Fukui, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/995,734

(22) Filed: Nov. 29, 2001

(65) Prior Publication Data

US 2002/0088430 A1 Jul. 11, 2002

(30) Foreign Application Priority Data

Jan. 6, 2001 (JP) ..... 2001-167053

(51) Int. Cl.[7] ..... F02P 9/00
(52) U.S. Cl. ..... 123/335; 123/609; 123/334
(58) Field of Search ..... 123/319, 334, 123/335, 594, 609, 612

(56) References Cited

U.S. PATENT DOCUMENTS 4,362,144 A * 12/1982 Yamaguchi et al. ..... 123/609
4,762,110 A * 8/1988 Iwata ..... 123/609
4,848,304 A * 7/1989 Iwata ..... 123/609
5,161,503 A * 11/1992 Yano et al. ..... 123/335

FOREIGN PATENT DOCUMENTS

JP 59-105969 6/1984 ..... F02P/11/02

* cited by examiner

*Primary Examiner*—Bibhu Mohanty
(74) *Attorney, Agent, or Firm*—Sughrue Mion, PLLC

(57) ABSTRACT

An ignition control system is provided, which includes: an engine speed detector (101) for calculating an engine speed according to an engine crank angle signal (100); a current supply start controller (102) for outputting a proper current supply start timing signal corresponding to the engine speed to an ignition coil (5); a current supply finish controller (103) for outputting a proper current supply timing signal corresponding to the engine speed to an ignition coil; an ignition coil controller (104) for controlling supply of power to the ignition coil (5) according to the current supply start timing signal and the current supply finish timing signal; and an overspeed determination device (105) for outputting an overspeed determination signal when determining that the engine speed is in excess of a predetermined limit value. The overspeed determination signal prohibits starting the supply of current, and retards the current supply finish timing to such a degree as to decrease engine torque.

5 Claims, 10 Drawing Sheets

IGNITION CONTROL SYSTEM

BACKGROUND OF THE INVENTION

1. Field of the Invention

This invention relates to an ignition control system, and more particularly to an ignition control system for protecting an internal combustion engine from overspeed.

2. Description of Related Art

FIG. 10 shows ignition control timings of a conventional internal combustion engine. When a driver turns on an ignition at the start of the internal combustion engine (hereinafter referred to as "engine"), current is supplied to a control unit for controlling the engine and a variety of sensors and actuators attached to the engine. If the driver then turns an ignition switch, a starter is directly connected with a battery to crank the engine. If the engine is cranked, the control unit controls the engine so as to start injecting fuel to each cylinder and ignite fuel in each cylinder. It is known that the supply of current to an ignition coil is stopped for extinguishment in order to protect the engine from overspeed. In the case of a transistor ignition coil control system, it is necessary to stop the supply of current in order to extinguish the fuel in the cylinder. If the overspeeding state is detected in a timing 2-1 in FIG. 10, however, a cylinder 2 that is currently supplied with current is ignited even if the supply of current is stopped, because the supply of current starts at a point P1 and the current-carrying period required for ignition has already elapsed. The supply of current to subsequent cylinders is canceled for extinguishment. For this reason, the overspeed protection may be delayed.

Since the overspeeding state is very dangerous to internal combustion engines, it is preferable to reduce the time from the detection of the overspeeding state to the start of the overspeed protection. According to the above-mentioned prior art, the overspeed protection is started from a cylinder that is supplied with current next time, and thus, the ignition control system cannot achieve the satisfactory responsiveness.

SUMMARY OF THE INVENTION

It is therefore an object of the present invention to provide an ignition control system that improves the responsiveness to overspeed by reducing the time period from the detection of the overspeeding state to the start of the overspeed protecting operation without deteriorating the normal ignition control characteristics.

In view of the above object, an ignition control system according to the present invention comprises: engine speed detecting means for calculating an engine speed according to an engine crank angle sensor signal; current supply start control means for outputting a proper current supply start timing signal corresponding to the engine speed to an ignition coil; current supply finish control means for outputting a proper current supply finish timing signal corresponding to the engine speed to the ignition coil; ignition coil control means for controlling supply of current to the ignition coil according to the signals outputted from the current supply start control means and the current supply finish control means; and overspeed determination means for outputting an overspeed determination signal when determining that the engine speed calculated by the engine speed detecting means is in excess of a predetermined limit value, wherein the current supply finish control means resets a timing for finishing the supply of current to the ignition coil being supplied with current to a timing on and after a time indicated by the current supply finish timing signal to thereby inhibit engine from revolving.

The overspeed determination signal may prohibit the current supply start control means from starting the supply of current, and may cause the current supply finish control means to retard the current supply finish timing so as to decrease engine torque.

Also, the overspeed determination signal may cause the current supply finish control means to retard the current supply finish timing so as to decrease engine torque.

The overspeed determination signal may prohibit the current supply finish control means from finishing the supply of current to thereby enable extinguishment.

The ignition control system according to the present invention may further comprise power supply control means for controlling supply of power to the ignition coil control means according to the overspeed determination signal. In this case, the overspeed determination signal causes the power supply control means to stop supplying power to the ignition coil control means, and prohibits the current supply finish control means from finishing the supply of current to gradually discharge a voltage having been supplied to the ignition coil control means to thereby enable extinguishment of the ignition coil.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of the present invention will now be described with reference to the accompanying drawings.

Embodiment 1

Figure 1:
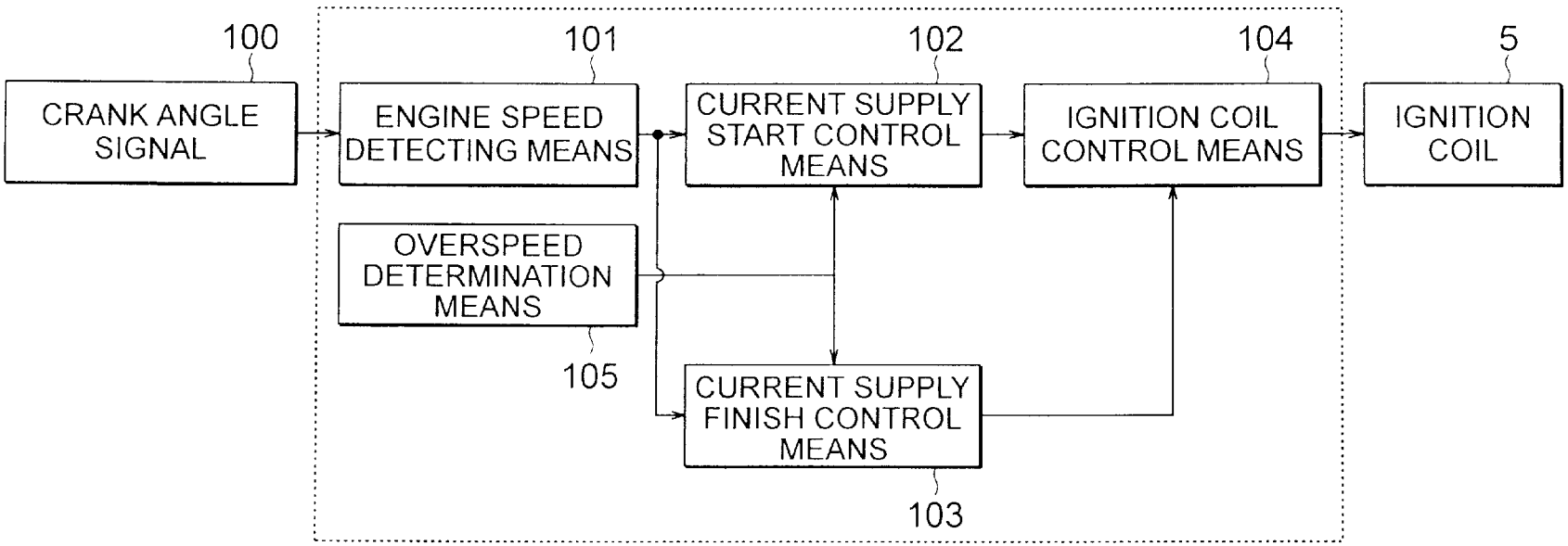
FIG. 1 is a block diagram showing the basic structure of an ignition control system according to embodiments 1 through 3 of the present invention.

FIG. 1 is a block diagram showing the basic structure of an ignition control system according to an embodiment 1. In FIG. 1, reference numeral 100 denotes a crank angle signal that is outputted from a crank angle sensor attached to an engine; 101 is an engine speed detecting means that calculates an engine speed based on the crank angle signal 100 of the engine; 102 is a current supply start control means that outputs a current supply start timing signal to an ignition coil with a proper timing corresponding to the engine speed; 103 is a current supply finish control means that outputs a timing signal for stopping the supply of current to the ignition coil with a proper ignition timing; 104 is an ignition coil control means that controls the supply of current to the ignition coil according to the signals outputted from the current supply start control means 102 and the current supply finish control means 103; and 105 is an overspeed determination means that outputs an overspeed determination signal when determining that the engine speed calculated by the engine speed detecting means 101 is in excess of a limit value. And, reference numeral 5 denotes the ignition coil.

There will now be described the operations of the ignition control system. First, the engine speed detecting means 101 receives a crank angle signal from the engine, and calculates the engine speed based on the signal. The current supply start control means 102 outputs a current supply start timing signal to the ignition coil with a proper timing corresponding to the engine speed which is calculated by the engine speed detecting means 101. The current supply finish control means 103 outputs a timing signal for stopping the supply of current to the ignition coil with a proper ignition timing. The ignition coil control means 104 controls the supply of current to the ignition coil 5 according to the signals outputted from the current supply start control means 102 and the current supply finish control means 103. On this occasion, if the overspeed determination means 105 determines that the engine speed calculated by the engine speed detecting means 101 is in excess of the limit value and then outputs an overspeed determination signal to the current supply start control means 102 and the current supply finish control means 103, the overspeed determination signal prohibits the current supply start control means 102 from starting the supply of current and causes the current supply finish control means 103 to retard the current supply finish timing to such a degree as to decrease engine torque.

Figure 2:
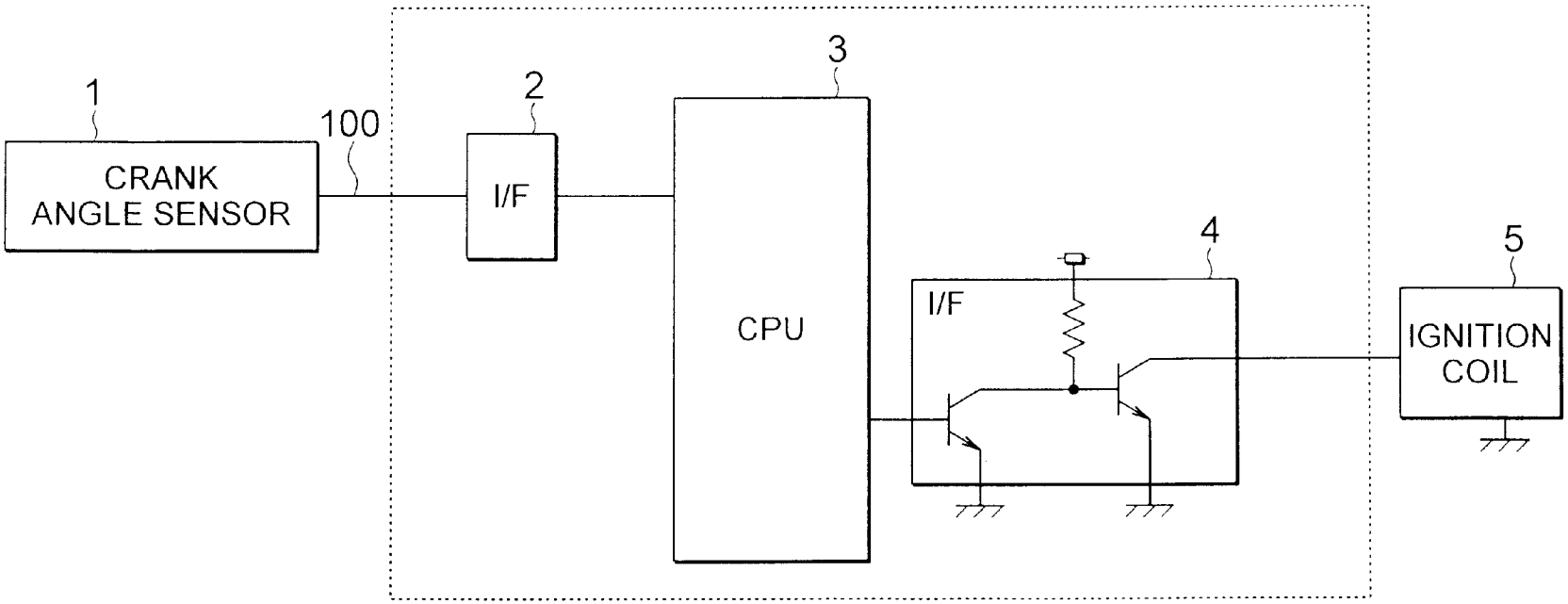
FIG. 2 is a block diagram showing the concrete structure of the ignition control system according to the embodiments 1 through 3 of the present invention.

FIG. 2 is a block diagram showing the concrete structure of the ignition control system according to the present embodiment. In FIG. 2, reference numeral 1 denotes the above-mentioned crank angle sensor; 2 is an I/F that shapes the waveform of the crank angle signal 100 outputted from the crank angle sensor 1; 3 is a CPU that performs various operations to calculate the engine speed, the ignition timing of the ignition coil, and the like; and 4 is an I/F that outputs the results of the operations performed by the CPU 3 to the ignition coil 5.

There will now be described the operations of the ignition control system. The crank angle signal 100 detected by the crank angle sensor 1 is inputted to the CPU 3 through the waveform shaping I/F 2. The CPU 3 calculates the engine speed and the ignition timing of the ignition coil according to the crank angle signal 100. A signal corresponding to the calculated ignition timing is outputted to the ignition coil 5 through the I/F 4 to thus drive the ignition coil 5.

Figure 3:
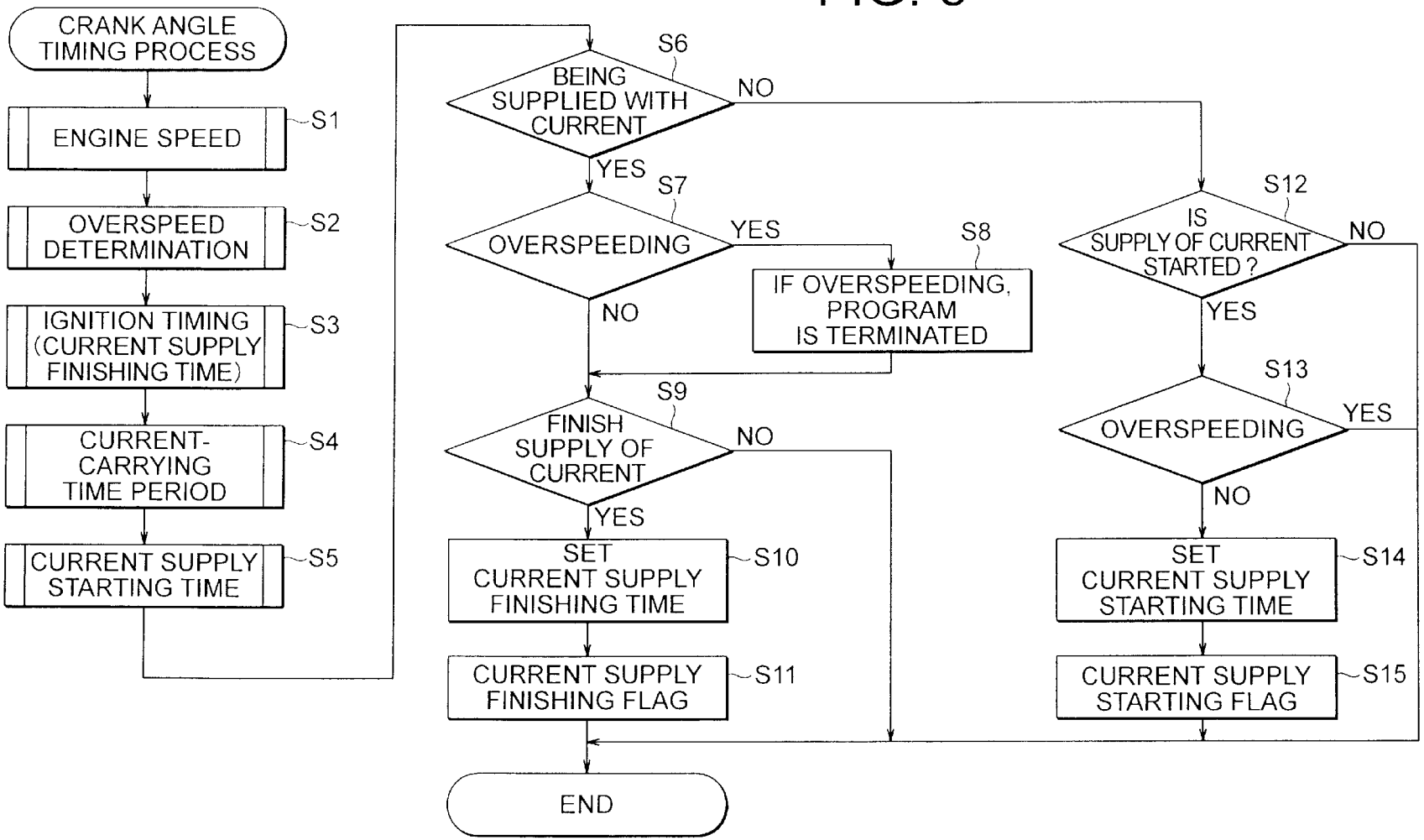
FIG. 3 is a flowchart of operations carried out by the ignition control system according to the embodiment 1 of the present invention.
Figure 4:
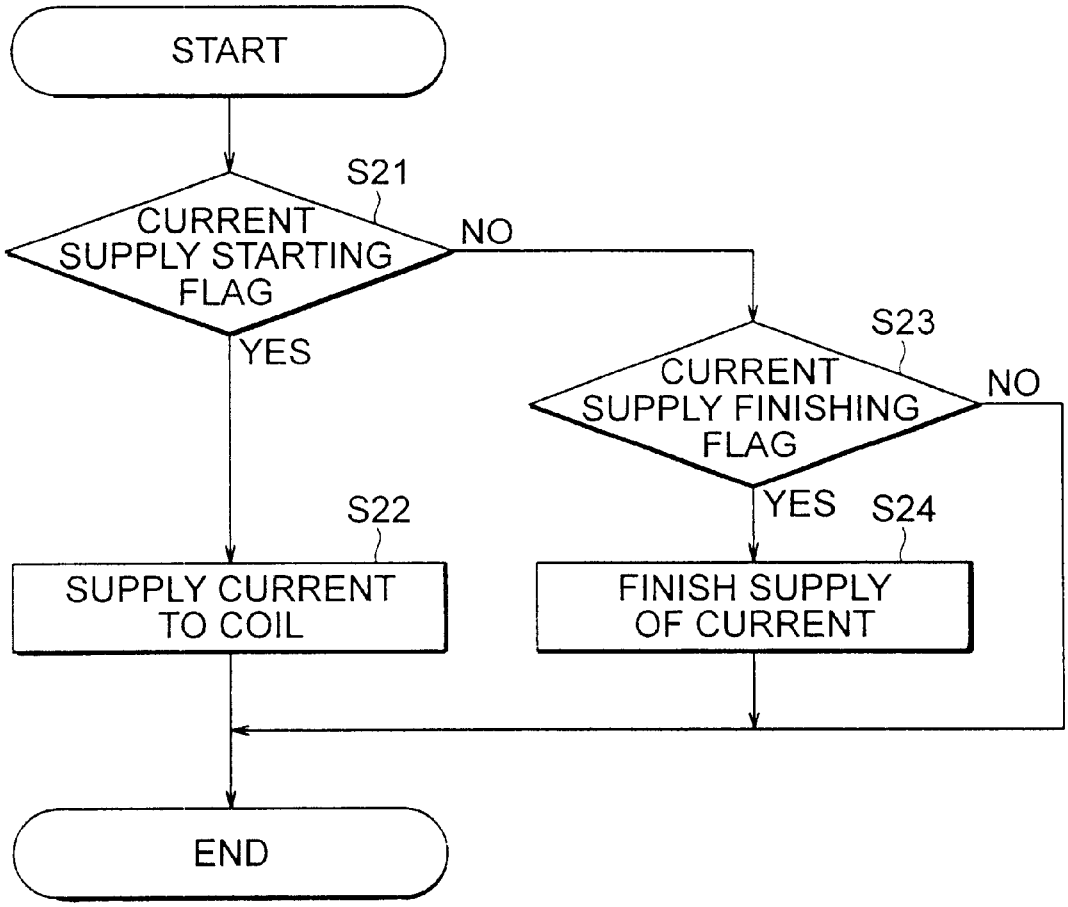
FIG. 4 is a flow chart of operations carried out by the ignition control system according to the embodiment 1 of the present invention.

FIGS. 3 and 4 are flow charts of the operations performed by the CPU 3. FIG. 3 shows the flow of operations carried out each time that the crank angle sensor 1 outputs the crank angle signal 100. The engine speed is calculated first at a step S1, and it is determined at a step S2 whether the engine is overspeeding or not. Next, the ignition timing corresponding to the present engine speed is calculated at a step S3. The calculated ignition timing is converted into a current supply finish time for the ignition coil 5 by referring to the engine speed and a time when interruption occurs. The current-carrying time period of the ignition coil 5 is calculated at a step S4. At a step S5, a current supply starting time is calculated according to the current supply finishing time calculated at the step S3 and the current-carrying time period calculated at the step S4. After the results are obtained by the above steps, the program proceeds to a next step.

At a step S6, the condition of the coil in the present crank timing, i.e. whether the ignition coil is supplied with current or not is determined. If determined no, the program proceeds to a step S12. At the step 12, whether a current supply start request should be outputted or not is determined according to the engine speed and the present time. If determined no, the program is terminated. If determined yes, the program proceeds to a step S13. At the step S13, it is determined whether the engine is overspeeding or not. If determined yes, the program is terminated without performing the current supply process from this point. This causes the ignition to be terminated as is the case with the prior art. If determined no, the program proceeds to a step S14. At the step S14, the previously calculated current supply starting time is set in a timer. The operations of the timer will be described later. At a step S15, a flag indicative of a wait for the current supply starting time is set.

There will now be described the operations carried out after the ignition coil is supplied with current (the determination is YES) at the step S6. At a step S7, it is determined whether the engine is overspeeding. If it is determined at the step S7 that the engine is overspeeding, the program proceeds to a step S8. If it is determined that the engine is operating in a normal state, the program proceeds to a step S9.

The step S8, which features the present invention, is carried out in the case where it is determined that the engine is overspeeding during the supply of current to the ignition coil. The coil, which is being supplied with current, is waiting for the supply of current to be finished at the current supply finishing time calculated at the step S3, i.e. waiting for an ignition timing. Since the overspeeding state is detected in this example, time data equivalent to an amount of a retard in relation to a time period required for lowering the engine speed from the previous current supply finish time, is added to a presently set current supply finish time. The program then proceeds to the step S9.

At the step S9, whether the current supply finishing time will reach by the starting time of the next timing operation is determined according to the engine speed and the present time. If determined no, the program is terminated. At a step S10, the current supply finishing time is set in the timer. The operations of the timer will be described later. At a step S11, a current supply finishing flag indicative of a wait for the current supply finishing time is set.

FIG. 4 is a flow chart of the operations for controlling start/stop of the current supply to each coil. The operations are carried out each time that the time set in the timer at the steps S10 and S14 in FIG. 3 reaches. Referring to FIG. 4, at step S21, it is determined whether the supply of current is started or not by checking the flag set at the step S15. If determined no, the program proceeds to a step S23, and if determined yes, the program proceeds to a step S22. At the step S22, a current supply starting process is carried out. On this occasion, the ignition coil control means 104 is required to supply current.

At the step S23, whether the supply of current is stopped or not by checking the flag set at the step S11. If determined no, the program is terminated, and if determined yes, the program proceeds to a step S24. At the step S24, a current supply stop request is outputted. Accordingly, the ignition coil stops carrying current.

In the above-mentioned steps, the setting can be made separately for the respective coils. Thus, when the overspeeding state is detected, the retard of the current supply finish timing, the extinguishment, and the like can be set separately for the respective cylinders.

Figure 5:
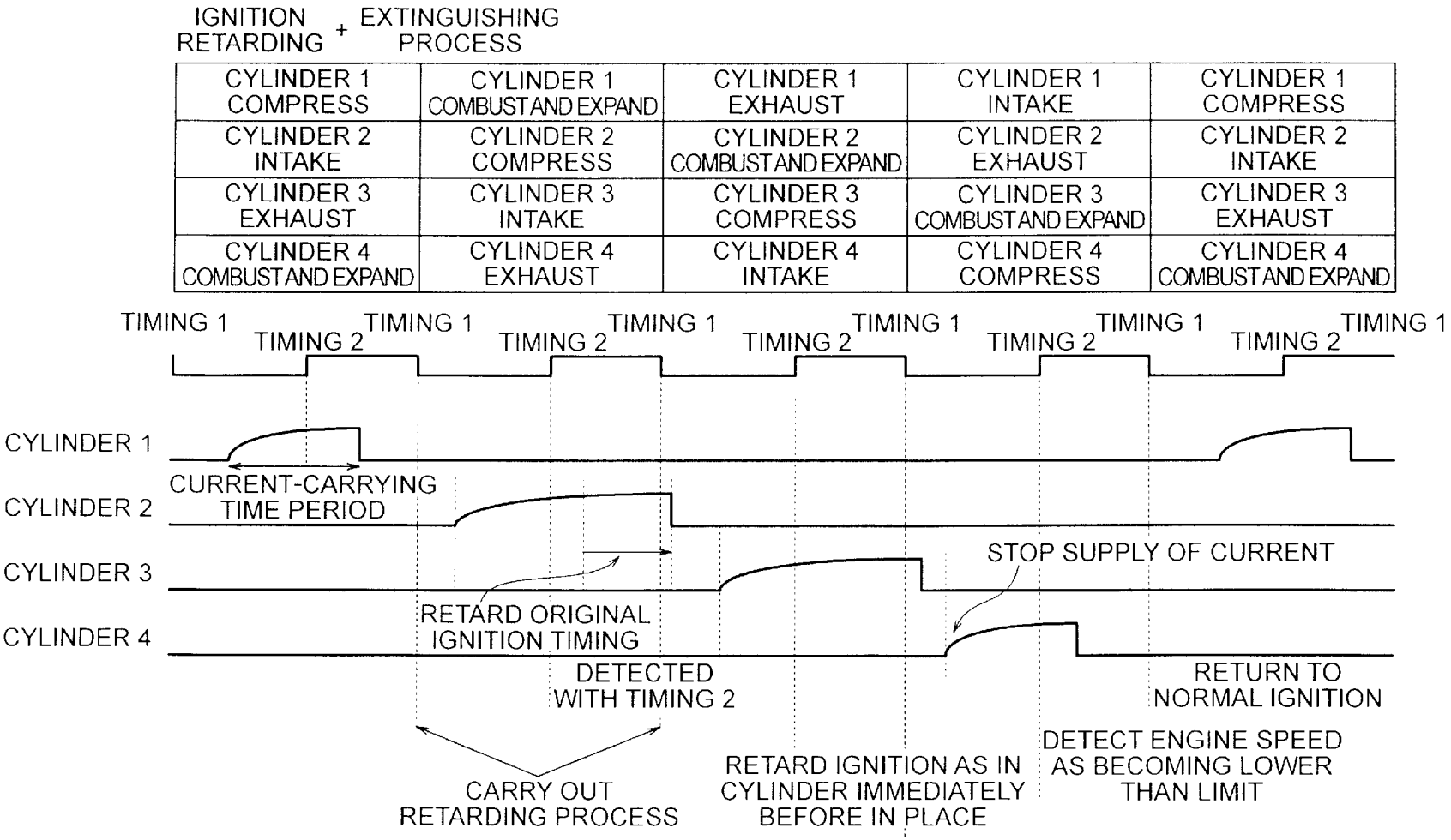
FIG. 5 is a timing chart showing the timings of operations carried out by an ignition control system according to the embodiment 1 of the present invention.

FIG. 5 shows the timings for inhibiting the supply of current according to the present embodiment. According to the present embodiment, the above-mentioned retarding process and the process for stopping the conventional current supply starting process are carried out sequentially. First, if the overspeeding state is detected, the retarding process is carried out for a coil that is being supplied with current with an overspeed detection timing, and for a coil of a next cylinder. If the retarding process alone can enable the engine to return from the overspeeding state, the conventional ignition process is carried out. If the retarding process alone cannot enable the engine to return from the overspeeding state, the extinguishment process is carried out to the subsequent cylinders until the engine returns from the overspeeding state.

As stated above, in the ignition control system according to the present embodiment, when the overspeed determination means 105 determines that the engine speed calculated by the engine speed detecting means 101 is in excess of the limit value and outputs an overspeed determination signal to the current supply control means 102 and the current supply control means 103, the overspeed determination signal prohibits the current supply start control means 102 from starting the supply of current and causes the current supply finish control means 103 to retard the current supply finish timing to such a degree as to decrease engine torque before finishing the supply of current. It is therefore possible to improve the responsiveness by reducing the time period from the detection of the overspeeding state to the start of the overspeed protecting operation without deteriorating the normal ignition control characteristics.

Embodiment 2

Figure 6:
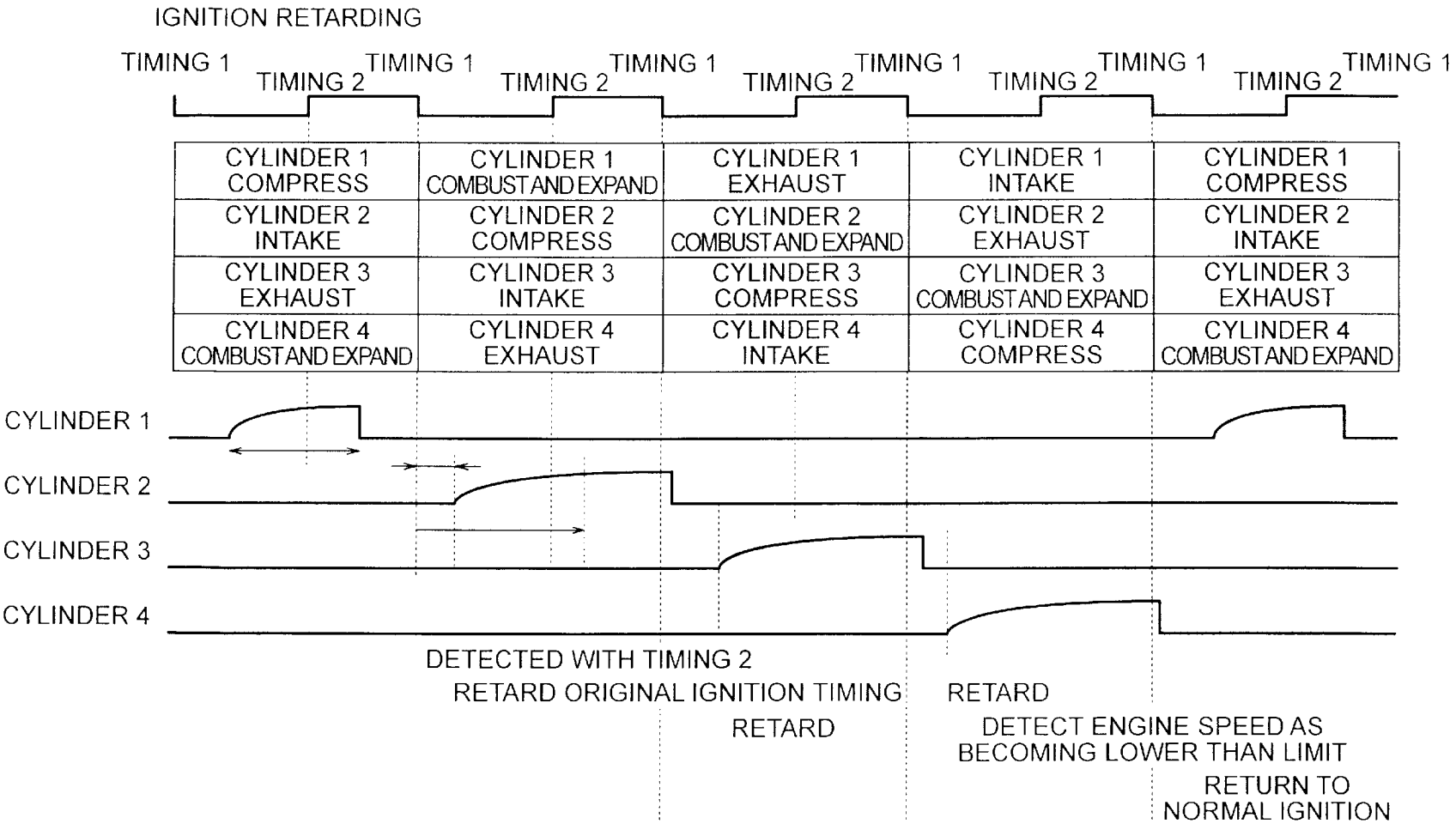
FIG. 6 is a timing chart showing the timings of operations carried out by an ignition control system according to the embodiment 2 of the present invention.

FIG. 6 is a timing chart of an ignition control system according to an embodiment 2. The structure of the ignition control system according to the present embodiment is basically the same as that in FIGS. 1 and 2, and the illustration thereof is therefore omitted here.

As shown in FIG. 6, the retarding process is carried out according to the present embodiment. More specifically, if the overspeeding state is detected with a timing 1 or 2, the retarding process is carried out for a cylinder immediately after in place with the timing 1 or for a coil that is being supplied with current with the timing 2. If the engine is detected as having returned from the overspeeding state, the program returns to the normal ignition process.

As stated above, in the ignition control system according to the present embodiment, when the overspeed determination means 105 determines that the engine speed calculated by the engine speed detecting means 101 is in excess of the limit value and outputs an overspeed determination signal to the current supply control means 102 and the current supply control means 103, the overspeed determination signal causes the current supply finish control means 103 to retard the current supply finish timing to such a degree as to decrease engine torque before finishing the supply of current. It is therefore possible to improve the responsiveness by reducing the time period from the detection of the overspeeding state to the start of the overspeed protecting operation without deteriorating the normal ignition control characteristics.

Embodiment 3

Figure 7:
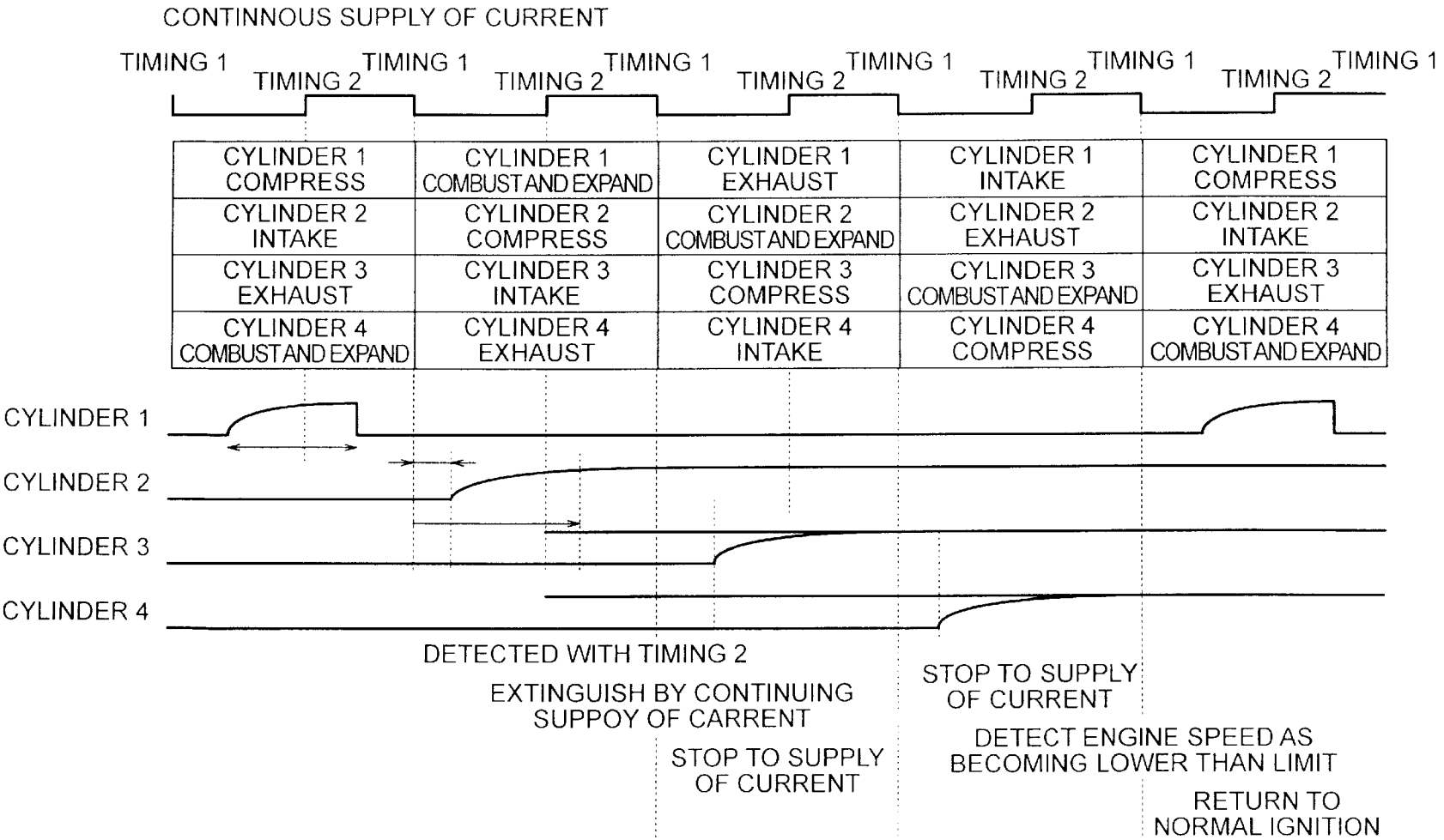
FIG. 7 is a timing chart showing the timings of operations carried out by an ignition control system according to the embodiment 3 of the present invention.

FIG. 7 is a timing chart of an ignition control system according to an embodiment 3. The structure of the ignition control system according to the present embodiment is basically the same as that in FIGS. 1 and 2, and the illustration thereof is therefore omitted here.

As shown in FIG. 7, the supply of current is prohibited from being finished according to the present embodiment. More specifically, if the overspeeding state is detected with a timing 1 or 2, the current is prohibited from being supplied to the coil that is being supplied with current. This causes the engine to return from the overspeeding state without igniting the ignition coil. If the engine is detected as having returned from the overspeeding state, the program returns to the normal ignition process.

As stated above, in the ignition control system according to the present embodiment, when the overspeed determination means 105 determines that the engine speed calculated by the engine speed detecting means 101 is in excess of the limit value and outputs an overspeed determination signal to the current supply start control means 102 and the current supply finish control means 103, the overspeed determination signal prohibits the current supply finish control means 103 from finishing the supply of current to enable extinguishment. It is therefore possible to improve the responsiveness by reducing the time period from the detection of the overspeeding state to the start of the overspeed protecting operation without deteriorating the normal ignition control characteristics.

Embodiment 4

Figure 8:
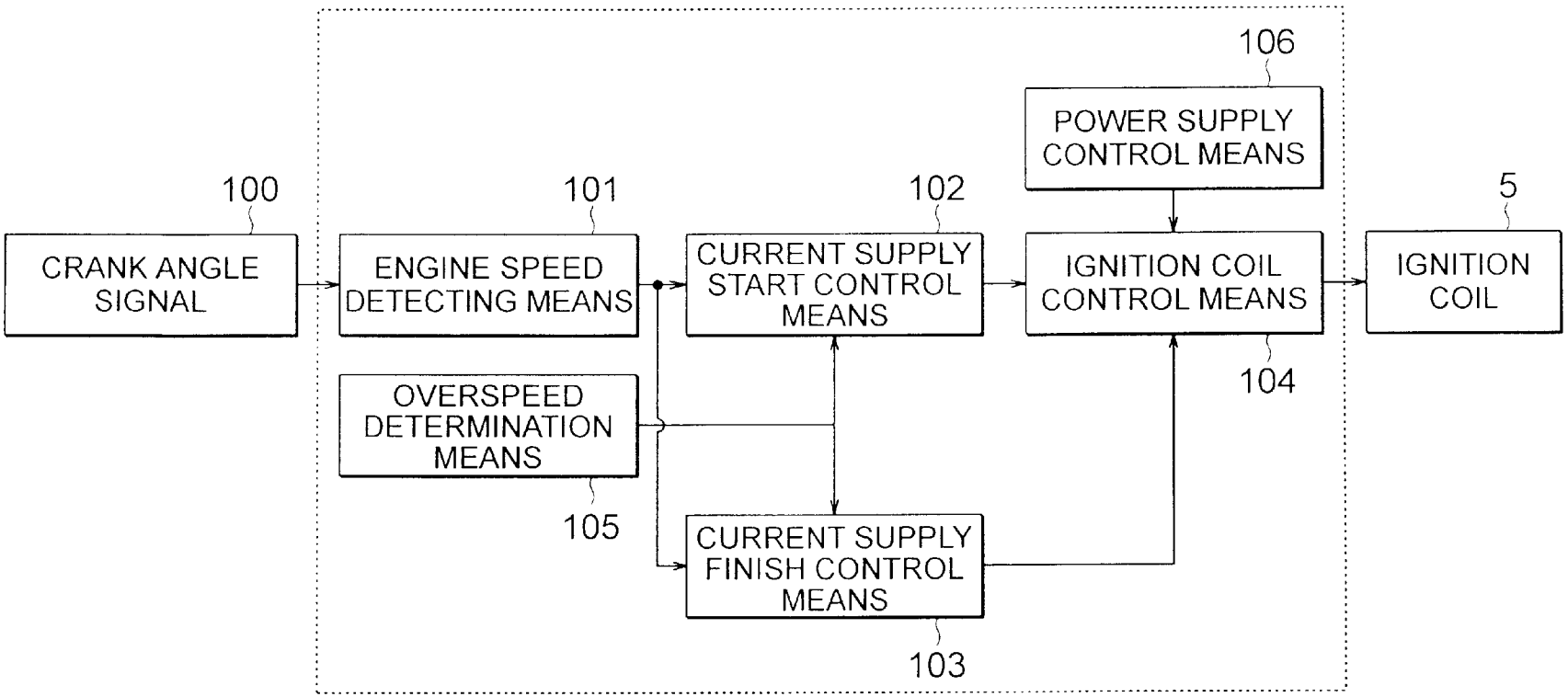
FIG. 8 is a block diagram showing the basic structure of an ignition control system according to an embodiment 4 of the present invention.
Figure 9:
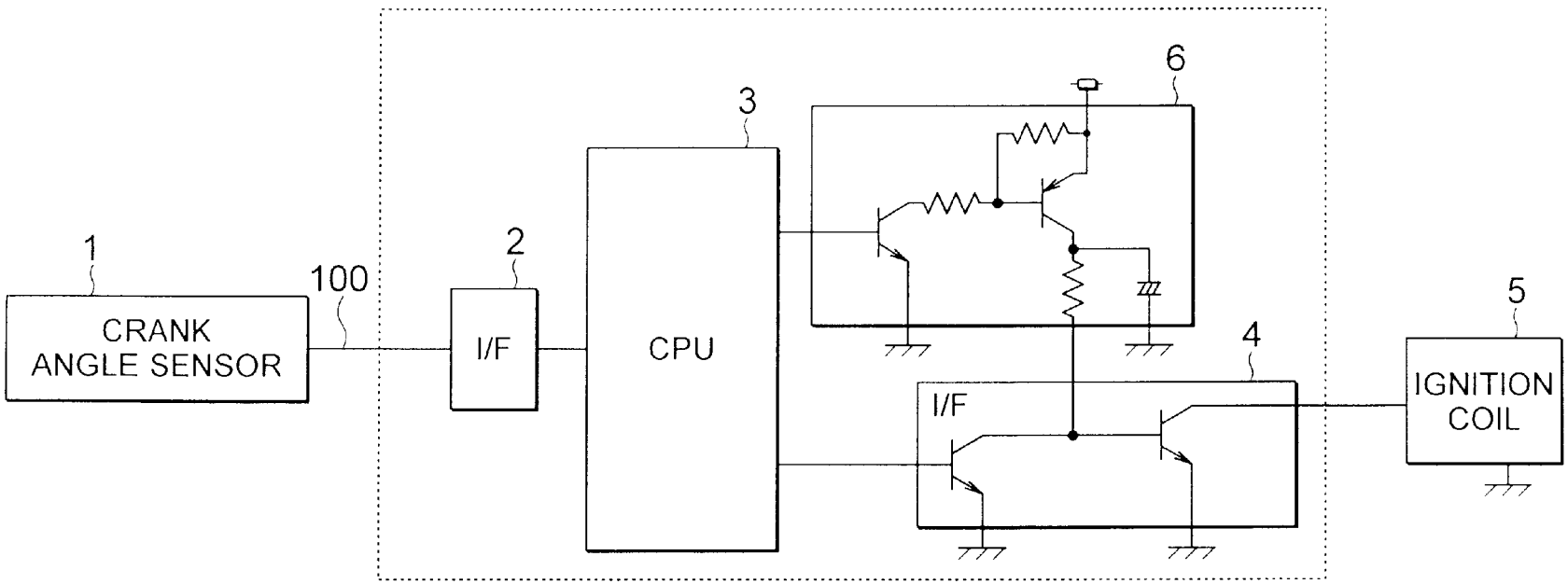
FIG. 9 is a block diagram showing the concrete structure of an ignition control system according to an embodiment 4 of the present invention.
Figure 10:
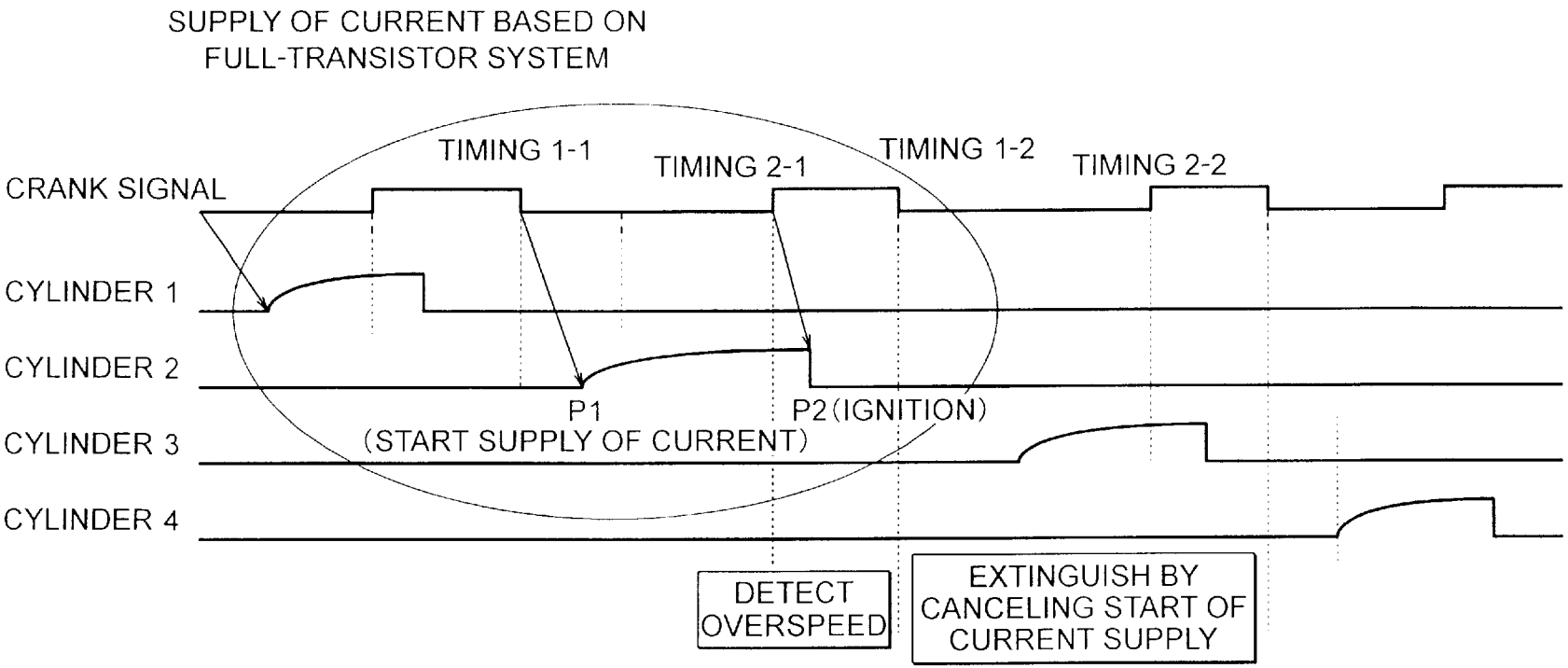
FIG. 10 is a timing chart showing the timings of operations carried out by a conventional ignition control system.

FIGS. 8 and 9 show the structure of an ignition control system according to an embodiment 4. In these figures, parts similar to those described with reference to FIGS. 1 and 2 are denoted by the same reference numerals, and a description thereof is therefore omitted here.

The ignition control system according to the present embodiment has a power supply control means 106, which controls the supply of power to the ignition coil control means 104, as well as the components shown in FIG. 1.

FIG. 9 is a block diagram showing the concrete structure of the ignition control system. As shown in FIG. 9, according to the present embodiment, a switching circuit 6, which switches on/off the supply of power, is provided between the I/F 4 and a power source in addition to the components shown in FIG. 2.

According to the present embodiment, when the overspeeding state is detected, the current supply finish control means 103 prohibits the supply of current from being finished. At the same time, the power supply control means 106 stops the supply of power to the ignition coil control means 104 so as to gradually discharge a voltage that has already been supplied to the ignition control means 104. This gradually decreases and finally stops the supply of current to the ignition coil 5. Therefore, the extinguishment can be performed without discharging the current from the ignition coil irrespective of the current-carrying period.

As stated above, the ignition control system according to the present invention is further provided with the power supply control means that controls the supply of power to the ignition coil control means, and the overspeed determination signal causes the power supply control means 106 to stop the supply of power to the ignition coil control means 104 and prohibits the current supply finish control means 103 from finishing the supply of current. This gradually discharges the voltage that has already been supplied to the ignition control means 104, thereby extinguishing the ignition coil 5. It is therefore possible to improve the responsiveness by reducing the time period from the detection of the overspeeding state to the start of the overspeed protecting operation without deteriorating the normal ignition control characteristics.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ignition control system comprising:

engine speed detecting means for calculating an engine speed according to an engine crank angle sensor signal;

current supply start control means for outputting a proper current supply start timing signal corresponding to the engine speed to an ignition coil;

current supply finish control means for outputting a proper current supply finish timing signal corresponding to the engine speed to the ignition coil;

ignition coil control means for controlling supply of current to the ignition coil according to the signals outputted from said current supply start control means and said current supply finish control means; and overspeed determination means for outputting an overspeed determination signal when determining that the engine speed calculated by said engine speed detecting means is in excess of a predetermined limit value, wherein said current supply finish control means resets a timing for finishing the supply of current to the ignition coil being supplied with current to a timing on and after a time indicated by the current supply finish timing signal to thereby inhibit engine from revolving.

2. An ignition control system according to claim 1, wherein the overspeed determination signal prohibits said current supply start control means from starting the supply of current, and causes said current supply finish control means to retard the current supply finish timing so as to decrease engine torque.

3. An ignition control system according to claim 1, wherein the overspeed determination signal causes said current supply finish control means to retard the current supply finish timing so as to decrease engine torque.

4. An ignition control system according to claim 1, wherein the overspeed determination signal prohibits said current supply finish control means from finishing the supply of current to thereby enable extinguishment.

5. An ignition control system according to claim 1, further comprising power supply control means for controlling supply of power to said ignition coil control means according to the overspeed determination signal, wherein the overspeed determination signal causes said power supply control means to stop supplying power to said ignition coil control means, and prohibits said current supply finish control means from finishing the supply of current to gradually discharge a voltage having been supplied to said ignition coil control means to thereby enable extinguishment of said ignition coil.

* * * * *